US005292999A

United States Patent [19]

Tumura

[11] Patent Number: 5,292,999

[45] Date of Patent: Mar. 8, 1994

[54] ELECTRIC STRINGED INSTRUMENT HAVING A DEVICE FOR SUSTAINING THE VIBRATION OF THE STRING

[75] Inventor: Kenji Tumura, Osaka, Japan

[73] Assignee: Fernandes Co., Ltd., Tokyo, Japan

[21] Appl. No.: 928,728

[22] Filed: Aug. 13, 1992

[30] Foreign Application Priority Data

Aug. 14, 1991 [JP] Japan ..... 3-204331

[51] Int. Cl.[5] ..... G10H 1/057; G10H 3/18

[52] U.S. Cl. ..... 84/728; 84/738; 84/DIG. 10

[58] Field of Search ..... 84/726–728, 84/738, DIG. 10

[56] References Cited

U.S. PATENT DOCUMENTS 4,941,388 7/1990 Hoover et al. .

FOREIGN PATENT DOCUMENTS 53-139836 12/1977 Japan .

52-151022 12/1977 Japan .

55-152597 12/1979 Japan .

*Primary Examiner*—Stanley J. Witkowski

*Attorney, Agent, or Firm*—Finnegan, Henderson, Farabow, Garrett & Dunner

[57] ABSTRACT

An electric stringed instrument having a device for sustaining the vibration of the string including an electromagnetic pickup for converting the vibration of the string to an electric signal, an amplifying device for amplifying the electric signal, and an electromagnetic driver for converting the amplified signal to a driving force to thereby drive the string. The electromagnetic pickup and the electromagnetic driver are placed at a right angle or a predetermined angle of inclination relative to each other so that induced electromotive forces caused by magnetic flux from the electromagnetic driver negate each other or do not occur in the electromagnetic pickup to thereby reduce the magnetic feedback in the device.

12 Claims, 9 Drawing Sheets

ELECTRIC STRINGED INSTRUMENT HAVING A DEVICE FOR SUSTAINING THE VIBRATION OF THE STRING

BACKGROUND OF THE INVENTION

1. Field of the Invention

The present invention relates to an electric stringed instrument having means for detecting the vibration of a string by an electromagnetic pickup, e.g., an electric guitar, an electric bass guitar and an electric piano, and more particularly to an electric stringed instrument having a device that drives the string by an electromagnetic driver to sustain the vibration of the string detected by the electromagnetic pickup.

A guitar or a piano differs from a violin in that after the string of a guitar or a piano is excited, the magnitude of the vibration of the string will become half within about a half second and die within about 7 seconds. Particularly, for example, in the case of an electric guitar, it seems that attenuation speed of the vibration of the string is shorter than that of an acoustic guitar because of the electric characteristics of an amplifier. Thus, an effector, which is a device for adding several sound effects, i.e., Delay, Reverb, Compressor and Overdrive, etc. to the sound of the guitar is often used to enable more sustained sound to be heard acoustically.

The effector using the Delay or the Reverb adds reverberations to a musical sound, and the sound is produced by recording and playing back the sound on a magnetic tape or by delaying the tone by a spring arrangement. Recently, simple electronic devices using BBD (Bucket Brigade Device) have been utilized for the Delay or the Reverb. The effector using the Compressor increases the amplitude of a music signal by an amplifier in reverse proportion to attenuation characteristics of the vibration of the string, and the Overdrive amplifies the signal beyond a permissible level so as to obtain a long tone. A longer tone is available by using these effectors, although the effectors cannot maintain the tone after the vibration of the string has stopped.

Now, musicians investigate various sounds and develop the art of musical performance in order to play said various sounds in response to their individual artistic impression. For example, a style using a loudspeaker feedback is one that produces the sound of a guitar at high volume so as to sustain the vibration of the string on the guitar for a long time without attenuation by way of sympathetic vibration in cooperation with air vibration emitted from the loudspeaker. As described above, the feedback can maintain the vibration of the string for a long time, but in order to maintain the sound, the player must utilize a skilled and high-grade technique to overcome several limitations, i.e., a sound of volume, location of the amplifier, length of the strings and musical interval etc. Further, there is a weak point in that the tone of the first string on the treble side, which is most significant for musical expression, cannot be easily sustained. Therefore, a device that easily sustains the vibration of the string for an extended period is in demand.

2. Description of the Prior Art

Several prior arts disclose means for sustaining the vibration of the string in relation to an electric stringed instrument. For example, Patent KOKAI 52- 151022 and Utility Model KOKAI 53-139836 (Both applicants are Roland Ltd.) disclose such a type of an electric guitar such that the strings of the guitar are connected with an electric driving circuit mounted within the guitar, and a positive feedback current output from the circuit flows through the strings as a part of the circuit when detecting the vibration of the strings at a pickup on the guitar and then the strings, in which the positive feedback current is flowing, vibrate in cooperation with a magnet attached to a surface of the guitar. This type of guitar has no use of an electromagnetic driver that converts an electric signal into a magnetic driving force utilizing a variation of magnetic flux corresponding to the signal and drives the metal string by the driving force. Thus, the guitar has the advantage of having no generation of so-called "magnetic feedback" which is introduced by a leakage of flux fed back from the electromagnetic driver to an electromagnetic pickup. The electromagnetic pickup converts a variation of magnetic flux produced by the vibration of the metal string into an electric signal, but the guitar needs an outside powder supply to provide power for the self-driving strings. Further it must have a strong magnet to drive the strings, in which the positive feedback current flows, and also the system becomes large by connecting the strings to the circuit. Therefore, said type of electric guitar needs to be designed as an exclusive instrument, and consequentially it is not practical to manufacture it on a commercial basis.

Further, the other disclosure is described in Utility Model KOKAI 55-152597 (YAMAHA Ltd.). The pickup shown in the specification and the drawings uses a light-emitting element and a light-intercepting element, and thus, there is no need to consider the said magnetic feedback. However, this type of electric guitar does not use an electromagnetic pickup as described above so that a tone generated from said guitar is different from the tone of an electric guitar having a common electromagnetic pickup.

Furthermore, U.S. Pat. No. 4,941,388 (Hoover, et al.) discloses an arrangement that has an electromagnetic pickup and an electromagnetic driver in order to sustain vibration of the strings of an electric guitar without using the deformation type described above. The arrangement has an unbalancing device for putting the magnetic balance between the electromagnetic pickup and the electromagnetic driver out of balance so as to reduce the magnetic feedback, and as a particularly effective method, an embodiment using a shunting plate is disclosed. An electric guitar having a device for reducing the magnetic feedback by using the shunting plate is put into practical use and a device by the name of "Sustaniac" is available on the market. However, even if the shunting plate is used, a part of the magnetic feedback that cannot be completely absorbed into the shunting plate remains. In order to reduce the magnetic flux from the electromagnetic driver to the electromagnetic pickup as much as possible, the design of the shunting plate is limited to match magnetic characteristics precisely and an orientating winding pole pieces of the electromagnetic pickup and the electromagnetic driver, and further the shunting plate needs to utilize the only so-called hum-bucking pickup.

SUMMARY OF THE INVENTION

The purpose of the present invention is to provide an electric stringed instrument having a device for sustaining the vibration of the string that has a very simple arrangement to thereby reduce the induced electromotive force introduced by magnetic flux from an electromagnetic driver to an electromagnetic pickup.

According to the present invention an electric stringed instrument having a device for sustaining the vibration of the string comprises an electromagnetic pickup for converting the vibration of the string to an electric signal, amplifying means for amplifying said electric signal from an electromagnetic pickup, and the electromagnetic driver for converting said amplified signal to a driving force to drive the string, which driver is placed at a right angle or a predetermined angle of inclination relative to the electromagnetic pickup such that the induced electromotive forces caused by magnetic flux from the electromagnetic driver negate each other in the electromagnetic pickup to thereby reduce the magnetic feedback.

Also, according to the present invention, the electric stringed instrument having a device for sustaining the vibration of the string comprises the electromagnetic pickup and the electromagnetic driver that is placed at a right angle or a predetermined angle of inclination relative to the electromagnetic pickup such that the induced electromotive forces caused by magnetic flux from the electromagnetic driver are not produced at the electromagnetic pickup to thereby reduce the magnetic feedback.

Further, according to the present invention the electromagnetic driver has a pole piece that is placed at a right angle against said electromagnetic pickup such that the induced electromotive forces caused by magnetic flux from the electromagnetic driver negate each other in the electromagnetic pickup to thereby reduce the magnetic feedback, and both ends of the polo pieces are formed out of permeability elements respectively, to emit magnetic flux from each permeability element in the upper or lower directions.

Furthermore, according to the present invention the electromagnetic driver has two coils and two pole pieces attached to the coils, respectively, and attains a difference in level between the pole pieces such that induced electromotive forces caused by magnetic flux from the electromagnetic driver negate each other in the electromagnetic pickup to thereby reduce the magnetic feedback.

BRIEF DESCRIPTION OF THE DRAWINGS

The present invention will be more clearly understood from the description as set forth below with reference to the accompanying drawings.

DESCRIPTION OF THE PREFERRED EMBODIMENTS

Figure 1:
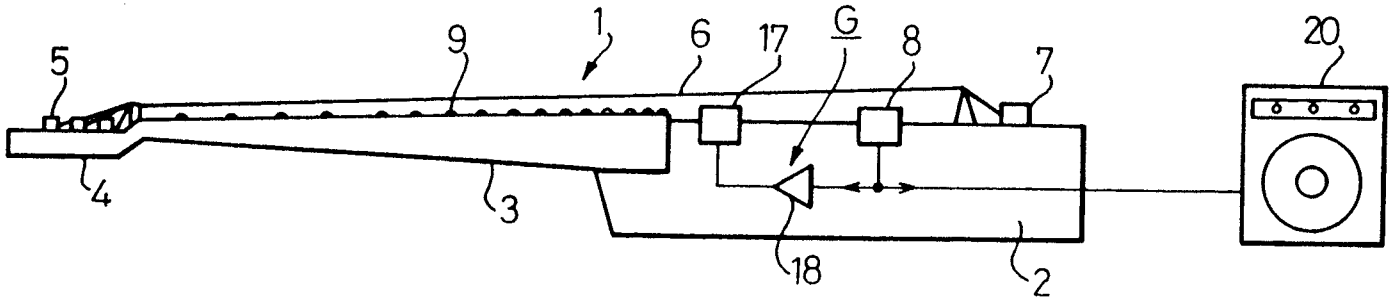
FIG. 1 is a general schematic arrangement of an electric guitar having a device for sustaining the vibration of strings.
Figures 2A, 2B:
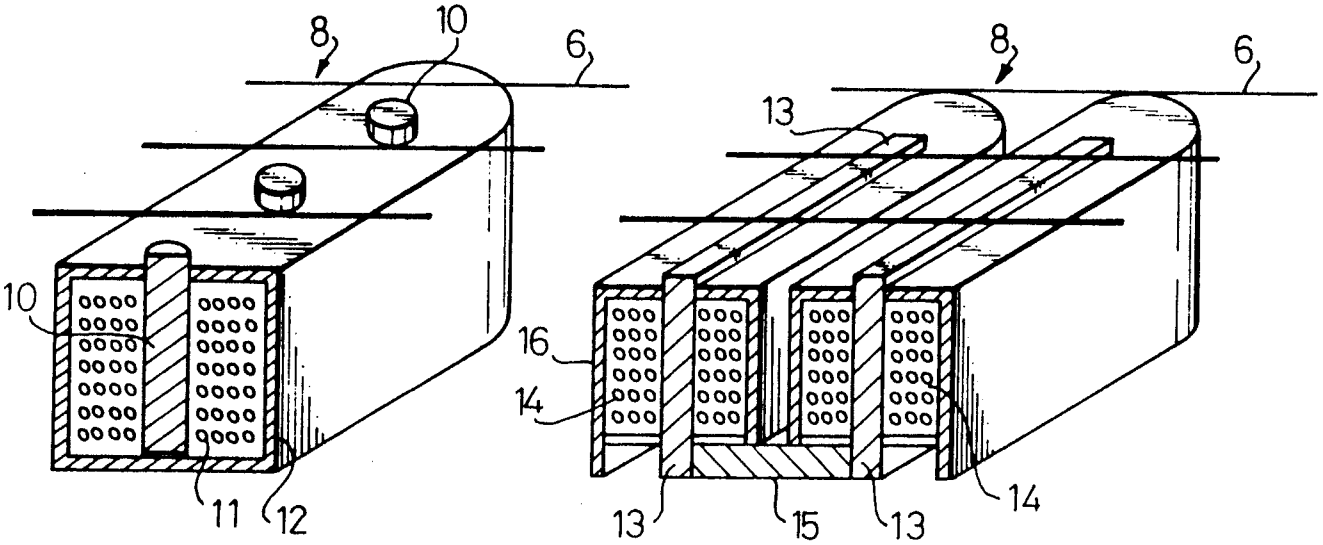
FIG. 2(*a*) and FIG. 2(*b*) are cross sectioned views of two types of electromagnetic pickups; one is a so-called single coil type pickup as shown in FIG. 2(*a*) and the other is a so-called double coil type pickup as shown in FIG. 2(*b*).

Before describing the preferred embodiments according to the present invention, examples of the related art are provided with reference to accompanying drawings (FIG. 1 and FIG. 2(*a*), (*b*)).

FIG. 1 shows an electric guitar that has a so-called "sustainer" G for sustaining the vibration of the string 6. In FIG. 1, an electric guitar 1 has a body 2 and a neck 3 combined with the body 2. Frets 9 are placed side by side on the surface of the neck 3 and a head 4 is shaped at an elongated end portion of the neck 3. A plurality of pegs 5 (string winder) are attached to the head 4 and each peg 5 has a structure winding up one end of a string 6 made of a metal conductive wire. The other end of the string 6 is fixed at a tailpiece 7 attached to the surface of the body 2. 8 is an electromagnetic pickup means. There are two types of typical pickup means 8 as shown in FIG. 2(*a*) and FIG. 2(*b*).

FIG. 2(*a*) is a so-called single coil type pickup that comprises pole pieces 10 made of a magnetic body i.e. a permanent magnet, a coil 11 wound up around the pole pieces 10 and cover 12. On the other hand FIG. 2(*b*) is a so-called double coil type pickup or a hum-bucking pickup that comprises two pole pieces 13 facing each other and is made of a pair of magnetic bodies i.e. a ferromagnetic material (FIG. 2(*b*) shows an example of a so-called bar type pole-piece.), coils 14 wound up around each pole piece 13 and a permanent magnet 15 combined magnetically with each pole piece 13. An induced electromotive force generated at both ends of the coil 11, 14 of the electromagnetic pickup 8 is produced by a variation of magnetic flux penetrating through the inside of the circumference of the coil 11, 14. The vibration of the conductive metal string 6 in the magnetic field causes a change in magnetic reluctance in the neighborhood of the electromagnetic pickup means 8 and thereby the magnetic flux density inside of the circumference of the coil 11, 14 varies in response to the vibration and an electric signal as the induced electromotive force is produced.

A signal detected at the electromagnetic pickup 8 is applied to a guitar amplifier 20 and the guitar amplifier 20 outputs a loud sound. On the other hand, the signal detected in the electromagnetic pickup means 8 is also applied to a sustainer G. The sustainer G comprises the electromagnetic pickup means 8, an amplifier means 18 and an electromagnetic driver means 17. A signal of the vibration of the string 6 detected at the electromagnetic pickup 8 is applied to the amplifier 18 within the guitar body 2 and the amplified signal is applied to the electromagnetic driver 17. The electromagnetic driver 17 basically uses the inverse of the principle of the electromagnetic pickup 8. The electric signal detected at the electromagnetic pickup 8 is amplified by the amplifier 18, and provided with an electromagnetic transducer, i.e. the electromagnetic driver 17 has the same structure as the electromagnetic pickup 8 shown in FIG. 2(*a*) or FIG. 2(*b*) and causes vibration of the string 6 by the flux emitted from the electromagnetic driver 17. However, the coil portion of the electromagnetic driver 17 is not the same as the electromagnetic pickup 8 because the electromagnetic driver 17 needs a lot of power to obtain significant flux and thereby drive the string 6. Accordingly the coil of the electromagnetic driver 17 uses a copper wire with a diameter of 0.3 mm bigger than the electromagnetic pickup 8's and the wire is wound about 200 turns, therefore the electromagnetic driver 17 has small electric resistance, about 7 ohms, and low power-loss characteristics.

However, the arrangement driving the string 6 by the electromagnetic driver 17 using the amplified signal detected at the electromagnetic pickup 8 has a problem in that it causes the so-called magnetic feedback effect. The magnetic feedback produces a needless induced electromotive force and the induced electromotive force at the electromagnetic pickup 8 is generated by feedback flux emitted from the electromagnetic driver 17, which emits strong flux in the neighborhood of the string 6 in order to driver the string 6. Further, there is another problems in that the magnetic feedback causes noise to occur in the higher harmonics region, namely 1,000–20,000 Hz, out of a fundamental vibration of the string 6.

Figure 3A:
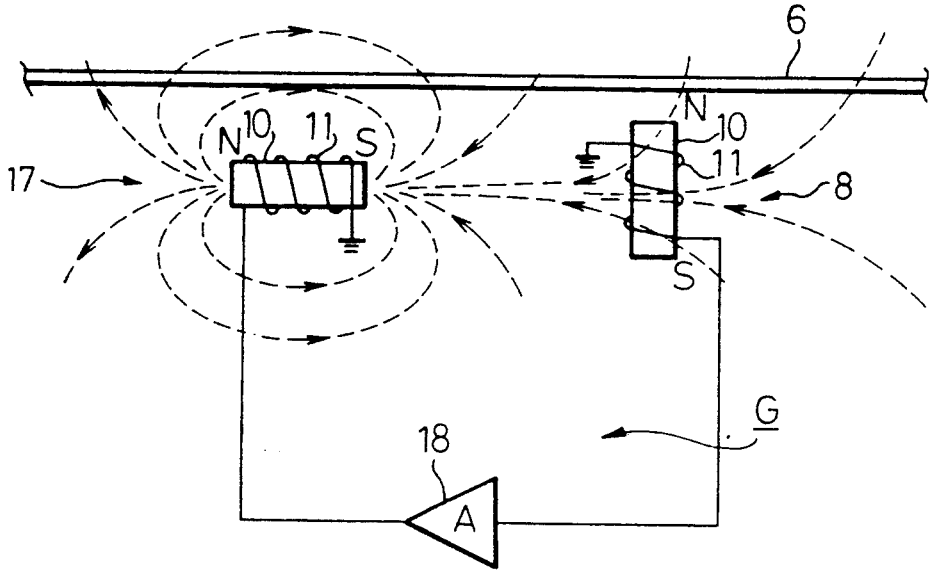
FIG. 3(*a*) and FIG. 3(*b*) are schematic views of two fundamental principles according to the present invention.
Figure 3B:
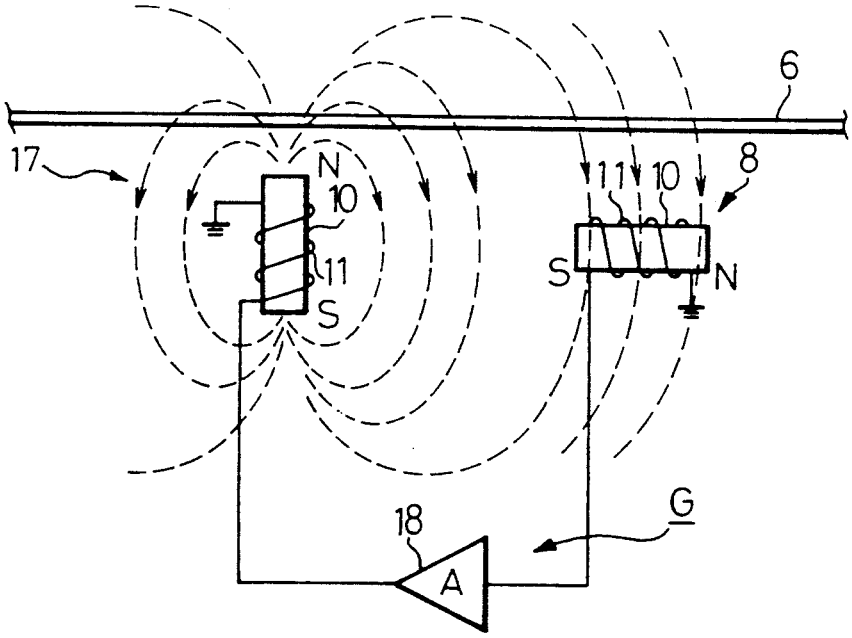

FIG. 3(*a*) and FIG. 3(*b*) show a schematic view of a fundamental principle of operation of a sustainer G for sustaining the vibration of the string 6, which is a main portion of the present invention. In FIG. 3(*a*), the single coil type pickup is used as the electromagnetic driver 17 and the electromagnetic pickup 8, and the electromagnetic driver 17 is placed at a right angle against the electromagnetic pickup 8. Also, in FIG. 3(*b*) the single coil type pickup is used as the electromagnetic driver 17 and the electromagnetic pickup 8, and the electromagnetic pickup 8 is placed at a right angle against the electromagnetic driver 17. FIG. 3(*a*) and FIG. 3(*b*) illustrate magnetic lines of force from the electromagnetic driver 17 only as shown by a dotted line, in order to clarify the concept of the invention in relation to the magnetic feedback. Accordingly, the magnetic line of force from the electromagnetic pickup 8 is not shown.

In FIG. 3(*a*) and FIG. 3(*b*), an electric signal of the vibration of the string 6 detected by the electromagnetic pickup 8 is amplified by the amplifier 18 and then applied to the electromagnetic driver 17. The electromagnetic driver 17 emits a strong magnetic line of force in the air to drive the string 6. If the electromagnetic pickup 8 detects the magnetic line of force from the electromagnetic driver 17, a positive feedback loop is formed through the electromagnetic pickup 8, the amplifier 18 and the electromagnetic driver 17, and the positive feedback loop causes noises and an oscillation within the loop, as described above. Therefore, according to the present invention, mutual orientation of disposition between the electromagnetic pickup 8 and the electromagnetic driver 17 is determined such that induced electromotive forces caused by magnetic flux emitted from the electromagnetic driver 17 negate each other in the electromagnetic pickup 8 as shown in FIG. 3(*a*), or such that induced electromotive forces are not produced at the electromagnetic pickup 8 as shown in FIG. 3(*b*).

In FIG. 3(*a*), the incident magnetic flux in the electromagnetic pickup 8 penetrates the upper and a lower end of the pole piece 10 evenly and in the opposite direction, and the induced electromotive force in the upper half portion of the coil 11 negates the opposite induced electromotive force in the lower half portion of the coil 11 so that the total induced electromotive force in the electromagnetic pickup 8 becomes substantially zero and the magnetic feedback decreases remarkably. An arrangement forming a difference in level between two pole pieces of the double coil type pickup has the same effect as described above. In FIG. 3(*b*), there is no generation of the induced electromotive force because there is no magnetic flux penetrating the inside of the circumference of the coil 11.

Figure 4:
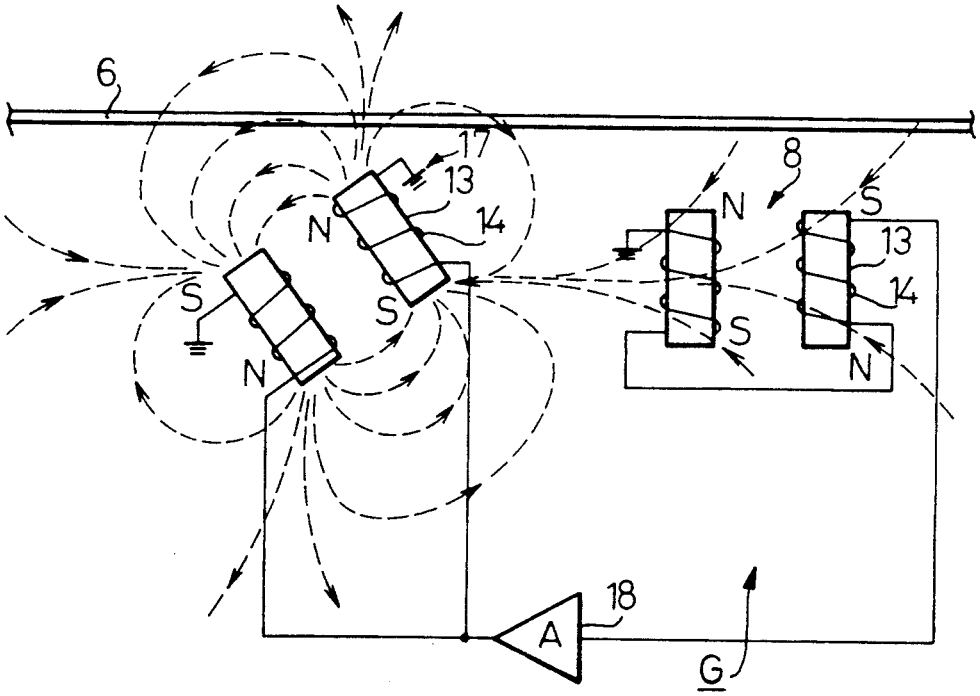
FIG. 4 is a schematic view of a preferred embodiment of the present invention using a double coil type pickup.

FIG. 4 is a schematic diagram indicating the case where the double coils type pickup is used as the electromagnetic driver 17 and the electromagnetic pickup 8. In this case, the radiation pattern (shown by a dotted line) of a magnetic line of force from the electromagnetic driver 17 is different from the radiation pattern of the single coil type pickup (FIG. 3) so that the electromagnetic driver 17 is placed at an angle of about 45 degree against the electromagnetic pickup 8, thereby causing the induced electromotive forces as a result of magnetic flux from the electromagnetic driver 17 to negate each other in the electromagnetic pickup 8 as well, as in FIG. 3(*a*) and the total induced electromotive force becomes substantially zero in the electromagnetic pickup 8.

Also, by placing any one or both of the electromagnetic drivers 17 and the electromagnetic pickup 8 at an angle of such inclination that the upper ends of the electromagnetic driver 17 and the electromagnetic pickup 8 adjacent to the string 6 are in directions opposite each other, it is possible to reduce the magnetic combination between the upper ends in inverse proportion to the square of a distance between the upper ends.

Further, by having an adjusting means for setting up an angle of inclination of the electromagnetic driver 17 using a rotary mechanism in order to adjust an emitting or an incident magnetic flux from the upper and lower ends of the pole pieces 13, it is possible to adjust the volume of the magnetic feedback in consideration of the total magnetic field of the guitar in the metal components thereof i.e. the Tremolo device and neck frets etc. mounted on the guitar.

Figure 5A:
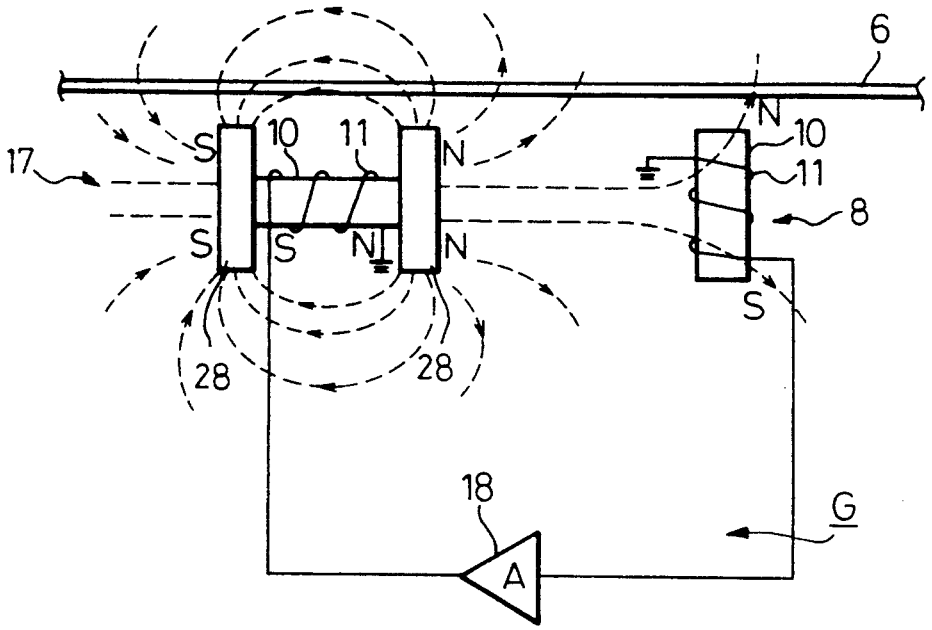
FIG. 5(*a*) and FIG. 5(*b*) are schematic views of preferred embodiments of the present invention using an electromagnetic driver having permeability elements formed on both ends of a pole piece of the electroma driver.
Figure 5B:
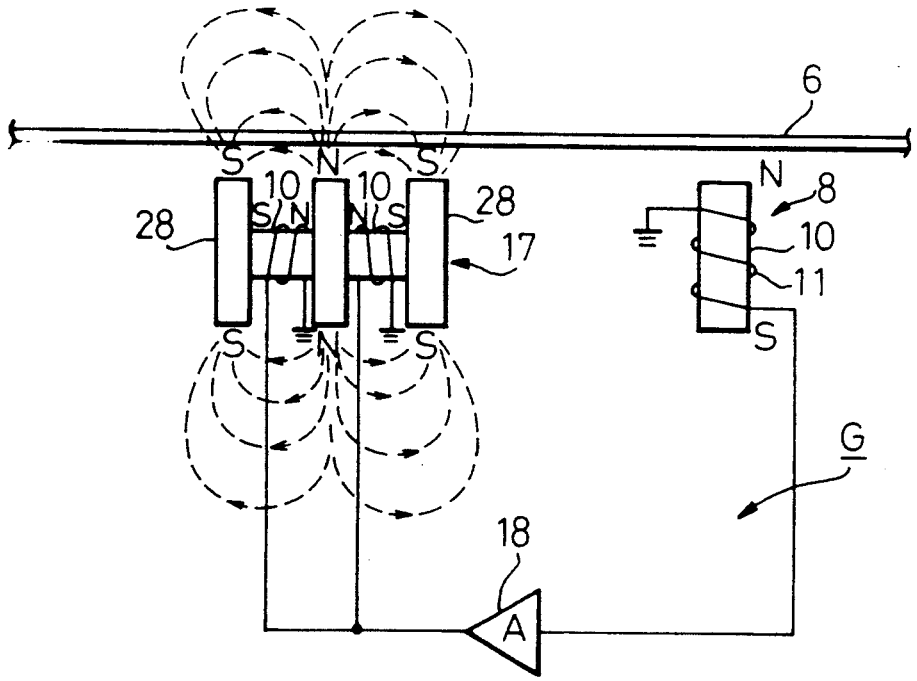
Figure 6A:
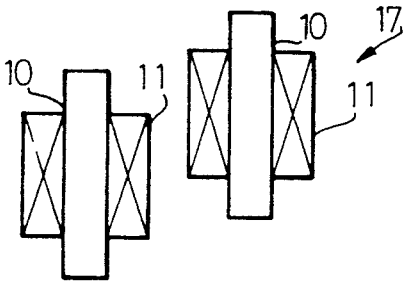
FIG. 6(*a*)–(*d*) are schematic views of preferred embodiments of the present invention using an electromagnetic driver having a difference in level between two pole pieces of the electromagnetic driver.
Figure 6B:
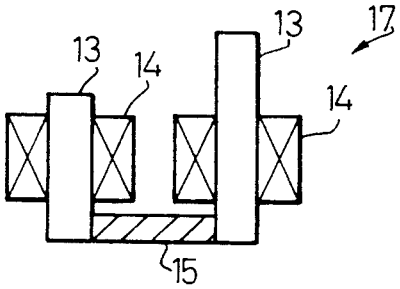
Figure 6C:
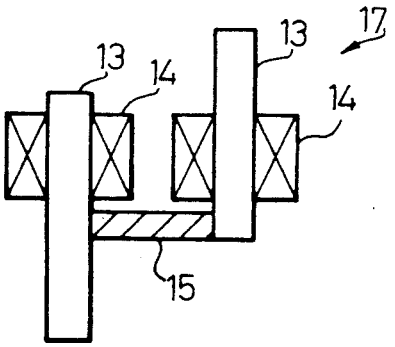
Figure 6D:
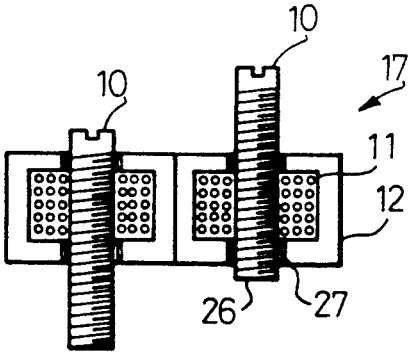

FIG. 5(*a*) indicates the case where permeability elements emitting magnetic flux in up and down directions are attached to both ends of the electromagnetic driver 17 as in FIG. 3(*a*), respectively, and a magnetic field similar to that of the single coil type pickup is produced. Also, the electromagnetic driver 17 of FIG. 3(*b*) is formed by making the electromagnetic driver 17 of FIG. 3(*a*) a double coil type pickup, and only a center permeability element of the three permeability elements 28 has a different polarity from the other elements.

FIG. 6(*a*)–6(*d*) is a schematic views of a preferred embodiment of the electromagnetic driver according to the present invention that uses a double coil type pickup as the electromagnetic driver 17 and has a difference in level between two pole pieces. The difference in level between the two pole pieces causes a magnetic field similar to the magnetic field produced by placing a double coil type pickup of FIG. 4 at an angle of inclination, and then the difference in level produces the same effect as reducing the induced electromotive force as in FIG. 4. FIG. 6(*d*) is an embodiment of an adjusting means for the difference in level between the two pole pieces 10 of the electromagnetic driver 17. By adjusting an emitting or an incident magnetic flux from the upper and lower ends of the pole pieces 10, 13, it is possible to adjust the volume of the magnetic feedback in consideration of the total magnetic field as described above. The adjusting means may be able to adjust the difference in level of the pole pieces 10, 13.

Figure 7A:
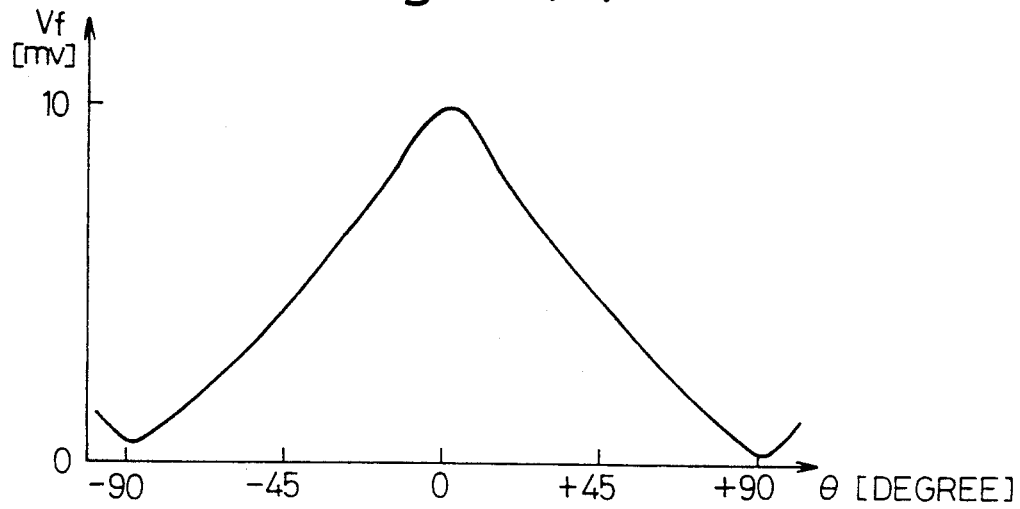
FIG. 7(*a*) and FIG. 7(*b*) show characteristic diagrams of the magnetic feedback corresponding to FIG. 3(*a*), (*b*) and FIG. 4 respectively.
Figure 7B:
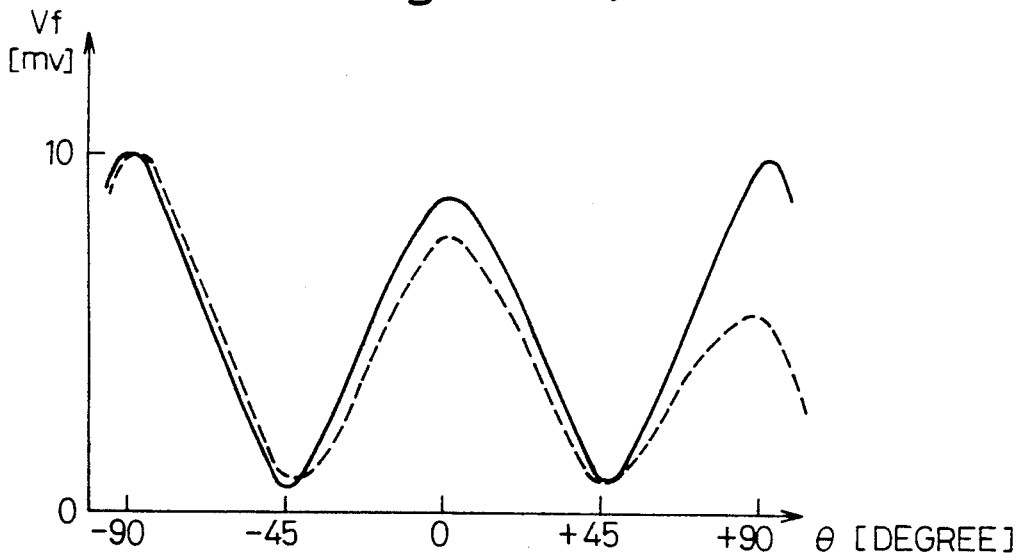

FIG. 7(*a*) and FIG. 7(*b*) are characteristic diagrams of the magnetic feedback of FIG. 3(*a*), FIG. 3(*b*) and FIG. (4). Each characteristic of FIG. 7(*a*) and FIG. 7(*b*) corresponds to FIG. 3(*a*), FIG. 3(*b*) and FIG. 4 respectively. In FIG. 7(*a*) and FIG. 7(*b*), $\theta$ is an angle of mutual inclination between the direction of magnetic poles of the electromagnetic driver 17 and the electromagnetic pickup 8. $\theta=0$ designates that both directions are parallel (the up and down direction in FIG. 3(*a*), FIG. 3(*b*) and FIG. 4). Any one of the electromagnetic drivers 17 and electromagnetic pickup 8 are fixed at $\theta=0$ and other is turned around the center axis of the electromagnetic driver 17 or the electromagnetic pickup 8. A sign "+" designates a clockwise rotation and a sign "−" designates an inverse clockwise rotation. Vf is an induced voltage of both ends of the coil 14 of the electromagnetic pickup 8 corresponding to the angle of inclination $\theta$ when a 1,500 Hz sine wave having 6 Vp-p provides the electromagnetic driver 17. In FIG. 7(*a*), the magnetic feedback is minimized by negating the induced electromotive force on each other when the electromagnetic driver 17 is placed at a right angle (+90° or −90°) against the electromagnetic pickup 8. Also, the magnetic feedback is minimized by generating no induced electromotive force when the electromagnetic pickup 8 is placed at a right angle (+90° or −90°) against the electromagnetic driver 17.

In FIG. 7(*b*), there are two points minimizing the magnetic feedback at the angles of about $\theta=+45°$ and −45° . Practically, as described above, the angle $\theta$ is selected to place any one or both of the electromagnetic drivers 17 and electromagnetic pickup 8 at an angle of such inclination that the upper ends of the electromagnetic pickup 8 and the electromagnetic driver 17 adjacent to the string 6 are in directions opposite each other.

The present invention will be more clearly understood from the brief description of embodiments applying the present invention to an electric guitar as set forth below with reference to the accompanying drawings of FIG. 8, FIG. 9 and FIG. 10(*a*)–(*d*).

Figure 8:
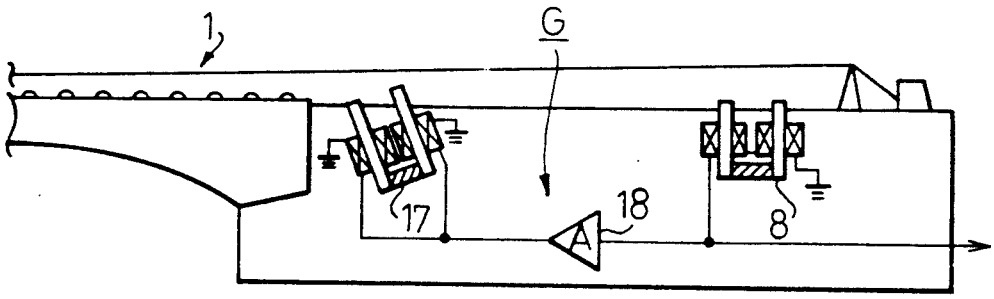
FIG. 8 is a schematic view of an arrangement of an electric guitar according to the present invention.

FIG. 8 is a schematic view of an arrangement of an electric guitar according to the present invention that uses the double coil type pickup 8 and driver 17 as well as the double coil type pickup in FIG. 2(*b*). Considering the characteristics in FIG. 7(*b*), the electromagnetic driver 17 is placed at an angle of such inclination that the upper end of the electromagnetic driver 17 adjacent to the string 6 is apart from the electromagnetic pickup 8.

Figure 9:
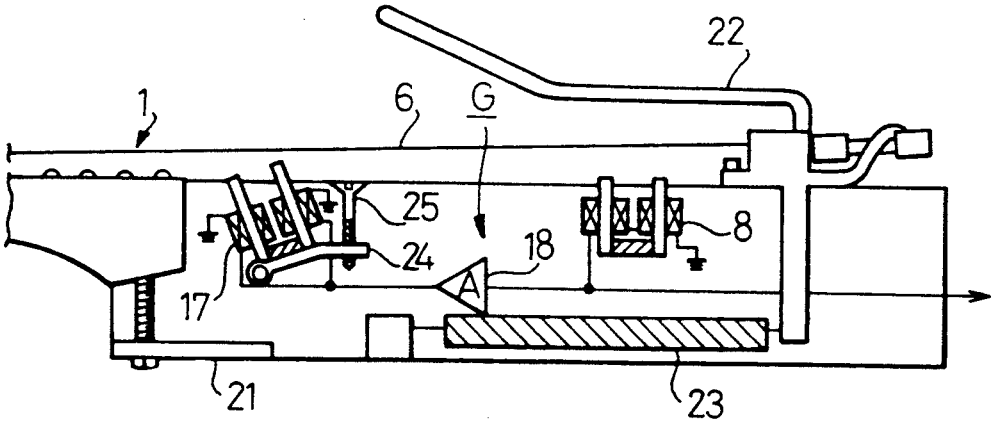
FIG. 9 is a schematic view adding implements and materials mounted on the guitar in an arrangement similar to FIG. 8.
Figure 10A:
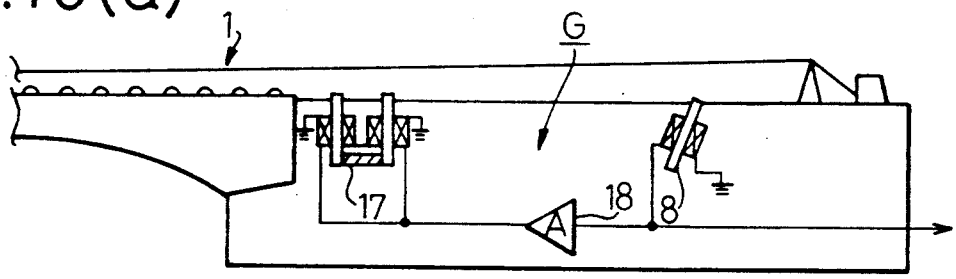
FIG. 10(*a*)–(*b*) are schematic views of various arrangements of an electric guitar according to the present invention.
Figure 10B:
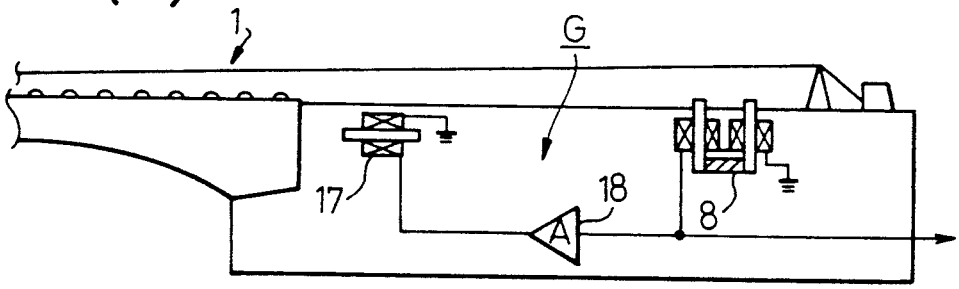
Figure 10C:
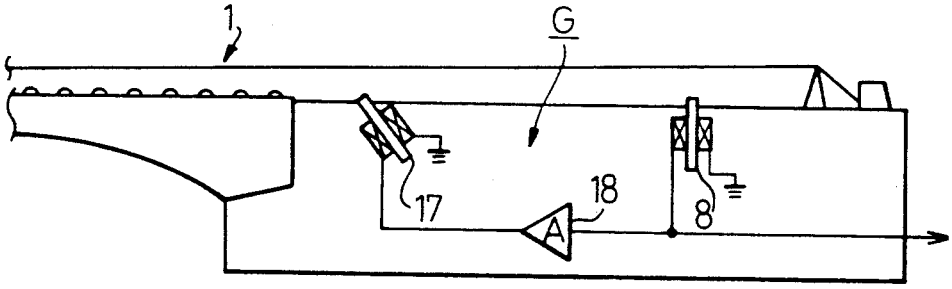
Figure 10D:
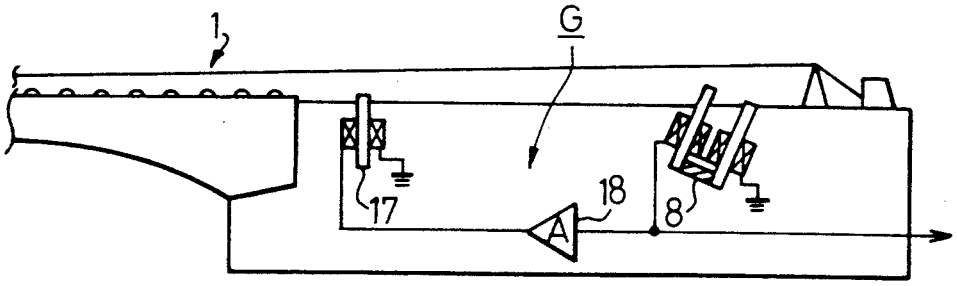

FIG. 9 is a schematic view of an arrangement of the electric guitar according to the present invention depicting the arrangement more briefly by adding components mounted on the guitar i.e. a conductive string 6, a metal Tremolo device 22, a metal spring 23 and a metal plate 21 supporting the neck 3 etc. In this case, the magnetic field in relation to the electromagnetic driver 17 and the electromagnetic pickup 8 is strained by these components. In this case, it is preferable to dispose the electromagnetic driver 17 and the electromagnetic pickup 8 as close as possible to the string 6 and dispose the electromagnetic driver 17 and electromagnetic pickup 8 such that an emitting or an incident magnetic line of force from the electromagnetic driver 17 penetrates the upper half and the lower half of the electromagnetic pickup 8 evenly. In such a case, it has been found experimentally that the magnetic feedback is minimized at about $\theta=45°$.

Also, as an example of an adjusting means for the angle of inclination of the electromagnetic driver 17 in FIG. 9 an adjusting bolt 25 and a rotary mechanism 24 are used. The adjusting means 24, 25 varies the ratio of the induced electromotive force generated at each end of the pole piece of the electromagnetic pickup 8, thereby making it possible to absorb the characteristic dispersion when manufacturing the guitar 1 and it provides a great deal of freedom of design of the guitar as described above. The adjusting means may have an other mechanism for varying $\theta$ angle instead of the adjusting bolt 25 and the rotary mechanism 24.

FIG. 10(*a*)–(*d*) are schematic views of several arrangements of the electric guitar according to the present invention. In FIG. 10(*a*), the electromagnetic pickup 8 using a single coil type pickup is placed at a predetermined angle of inclination. In FIG. 10(*b*), the electromagnetic driver 17 using a single coil type pickup is placed at a right angle against the electromagnetic pickup 8. FIG. 10(*c*) and FIG. 10(*d*) show examples of combinations of the electromagnetic pickup 8 and the electromagnetic driver 17 as well as FIG. 10(*a*) and FIG. 10(*b*). Also, in FIG. 10(*a*)–(*d*), it may be possible to use the magnetic driver having said permeability elements or said difference in level between the pole pieces of the electromagnetic driver 17. Further, both the electromagnetic pickup 8 and the electromagnetic driver 17 may be placed at a predetermined angle of inclination. Although, in each embodiment described above, the upper ends of the electromagnetic pickup 8 and electromagnetic driver 17 are brought into a separating relationship, the upper ends may be brought into closer relationship. Also, in the embodiments, the predetermined angle of inclination is about 90° or 45°, but the angle may be determined so as to minimize the induced electromotive force as far as existence of the metal components mounted on the guitar are concerned.

As described above, an electric stringed instrument having a device for sustaining the vibration of the string according to the present invention can reduce noises and oscillation etc. produced by the magnetic feedback by way of a very simple arrangement that places each direction of the electromagnetic pickup and the electromagnetic driver at a right angle or an angle of mutual inclination. Also, it is possible to increase the driving force of the string by using the permeability elements on both ends of a pole piece of the electromagnetic driver, which enables the portion emitting flux to be closer to the string. Furthermore, the double coil type pickup as shown in FIG. 5(*b*) can reduce leakage flux from the electromagnetic driver to the electromagnetic pickup by negating flux emitted from each coil respectively so that the magnetic feedback is reduced.

Further, by way of an arrangement of the present invention that negates the induced electromotive force onto each other or causes no induced electromotive force, there is no distance between the electromagnetic pickup and electromagnetic driver in relation to the magnetic feedback. Consequentially it is very effective to arrange some components in a narrow region such a guitar.

So far, only a double coil type pickup can be used to converge magnetic flux to a maximum, whereas according to the present invention it is possible to use a single coil type pickup so that the variety of the type of pickup used is greatly increased.

Further, according to the present invention it is possible to easily adjust the ratio between the induced electromotive force generated at one end of the electromagnetic pickup and the inverse induced electromotive force generated at the other end of the electromagnetic pickup, by adjusting the mutual angle of inclination between the pole directions of the electromagnetic pickup and the electromagnetic driver, or by adjusting the difference in level between the two pole pieces of the electromagnetic driver. Thereby, it becomes very easy to design and manufacture an electric guitar having a sustainer thereby reducing the magnetic feedback involving components mounted on the guitar, which is a great advantage.

I claim:

1. A device for sustaining the vibration of the string of an electric stringed instrument, comprising electromagnetic pickup mean for converting the vibration of a string of the instrument to an electric signal, amplifying means for amplifying the electric signal from said electromagnetic pickup means, and electromagnetic driver means for converting the amplified electric signal into a magnetic driving force to drive rand thereby sustain the vibration of the string; said electromagnetic pickup means and said electromagnetic driver means being arranged at a predetermined angel in relation to each other such that induced electromagnetic forces caused by magnetic flux from said electromagnetic driver means cancel each other in said electromagnetic pickup means to thereby reduce magnetic feedback in said device.

2. A device for sustaining the vibration of the string of an electric stringed instrument comprising electromagnetic pickup means for converting the vibration of a string of the instrument to an electrical signal, amplifying means for amplifying the electric signal from said electromagnetic pickup means, and electromagnetic driver means for converting the amplified electric signal into a magnetic driving force to drive and thereby sustain the vibration of the string; said electromagnetic pickup means and said electromagnetic driver means being arranged at a predetermined angle in relation to each other such that induced electromagnetic forces caused by magnetic flux from said electromagnetic driver means do not cover in said electromagnetic pickup means to thereby reduce magnetic feedback in said device.

3. The device for sustaining the vibration of the string of an electric stringed instrument of claim 1 or claim 2 wherein said electromagnetic driver means and said electromagnetic pickup means each have at least one pole piece for emitting magnetic flux in the direction of the axis thereof, said pole pieces each having upper and lower axial ends with the upper ends being adjacent the string, said pole piece of the driver means being arranged at said predetermined angel in relation to the pole piece of the pickup means such that the upper ends of the pole pieces of said electromagnetic pickup means and said electromagnetic driver means are separated from each other by a distance greater than the distance between the lower ends thereof.

4. The device for sustaining the vibration of the string of an electric stringed instrument of claim 1 or 2, wherein said electromagnetic driver means and said electromagnetic pickup means each have at least one pole piece for emitting magnetic flux in the direction of the axis thereof, said pole pieces being arranged at a right angle relative to each other.

5. The device for sustaining the vibration of the string of an electric stringed instrument of claim 1 or 2 wherein said electromagnetic driver means and said electromagnetic pickup means each have at least one pole piece for emitting magnetic flux in the direction of the axis thereof, said pole pieces being arranged at an angle about 45 degrees relative to each other.

6. The device for sustaining the vibration of the string of an electric stringed instrument of claim 3 wherein said predetermined angle between the pole pieces is about 45 degrees.

7. The device for sustaining the vibration of the string of an electric stringed instrument of claim 1 or 2, including adjusting means for adjusting said predetermined angle, said adjusting means having a rotating mechanism for changing the angle of inclination of said electromagnetic driver means in relation to said electromagnetic pickup means.

8. The device for sustaining the vibration of the string of an electric stringed instrument of claim 3, including adjusting means for adjusting said predetermined angle between the pole pieces, said adjusting means having a rotating mechanism for changing the angle of inclination of the pole piece of the electromagnetic driver means in relation to the pole piece of the electromagnetic pickup means.

9. A device for sustaining the vibration of the string of an electric stringed instrument comprising an electromagnetic pickup means for converting the vibration of a string of the instrument to an electric signal, amplifying means for amplifying the electric signal from said electromagnetic pickup means, and electromagnetic driver means for converting the amplified electric signal into a magnetic driving force to drive and thereby sustain the vibration of the string, said electromagnetic driver means and said electromagnetic pickup means each having pole pieces for emitting magnetic flux in the direction of the axis of said pole pieces, said pole piece of said electromagnetic driver means having permeable elements at both ends of the axis thereof so as to emit the flux in both directions evenly, sand said pole pieces of said electromagnetic driver means and said electromagnetic pickup means being arranged at a predetermined angle in relation to each other such that induced electromagnetic forces caused by magnetic flux from said electromagnetic driver means cancel each other or do not occur in said electromagnetic pickup means to thereby reduce magnetic feedback in said device.

10. The device for sustaining the vibration of the string of an electric stringed instrument of claim 9, wherein said permeable elements at both ends of the pole piece of the electromagnetic driver means have upper and lower ends with the upper ends being adjacent the string, the elements being arranged so that the upper and lower ends thereof are at different distances from the string.

11. A device for sustaining the vibration of the string of an electric stringed instrument comprising electromagnetic pickup means for converting the vibration of a string of the instrument to an electric signal, amplifying means for amplifying the electrical signal from said electromagnetic pickup means, and electromagnetic driver means for converting said amplified signal into a magnetic driving force to drive and thereby sustain the vibration of the string, said electromagnetic driver means having two pole pieces each having an upper end adjacent the string, said pole pieces being arranged so that the upper ends thereof are at different distances from the string so that induced electromagnetic forces caused by magnetic flux from said electromagnetic driver means cancel each other in said electromagnetic pickup means to thereby reduce the magnetic feedback in the device.

12. The device for sustaining the vibration of the string of an electric stringed instrument of claim 11, including adjusting means for adjusting said difference in distance between the upper ends of said pole pieces of said electromagnetic driver means.

* * * * *

UNITED STATES PATENT AND TRADEMARK OFFICE

CERTIFICATE OF CORRECTION

PATENT NO. : 5,292,999

DATED : March 8, 1994

INVENTOR(S) : Kenji Tumura

It is certified that error appears in the above-indentified patent and that said Letters Patent is hereby corrected as shown below:

Claim 1, column 9, line 25, change "mean" to --means--;

Claim 1, column 9, line 30, change "rand" to --and--;

Claim 1, column 9, line 33, change "angel" to --angle--;

Claim 2, column 9, line 52, change "cover" to --occur--;

Claim 3, column 9, line 63, change "angel" to --angle--;

and

Claim 9, column 10, line 48, change "sand" to --and--.

Signed and Sealed this

Twenty-seventh Day of September, 1994

*Attest:*

Bruce Lehman

BRUCE LEHMAN

*Attesting Officer*

*Commissioner of Patents and Trademarks*